US011575214B2

(12) United States Patent
Hand et al.

(10) Patent No.: US 11,575,214 B2
(45) Date of Patent: Feb. 7, 2023

(54) REFLECTARRAY ANTENNA SYSTEM

(71) Applicants: Thomas H. Hand, Linthicum Heights, MD (US); Michael E. Cooley, Severna Park, MD (US); David Sall, Owings Mills, MD (US); Gary L. Kempic, Ellicott City, MD (US)

(72) Inventors: Thomas H. Hand, Linthicum Heights, MD (US); Michael E. Cooley, Severna Park, MD (US); David Sall, Owings Mills, MD (US); Gary L. Kempic, Ellicott City, MD (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 1019 days.

(21) Appl. No.: 16/264,272

(22) Filed: Jan. 31, 2019

(65) Prior Publication Data

US 2019/0165485 A1 May 30, 2019

Related U.S. Application Data

(62) Division of application No. 14/054,267, filed on Oct. 15, 2013, now Pat. No. 10,263,342.

(51) Int. Cl.
*H01Q 19/18* (2006.01)
*H01Q 15/14* (2006.01)
(Continued)

(52) U.S. Cl.
CPC ..... *H01Q 19/18* (2013.01); *H01Q 1/38* (2013.01); *H01Q 3/46* (2013.01); *H01Q 7/00* (2013.01);
(Continued)

(58) Field of Classification Search
CPC ..... H01Q 21/28; H01Q 21/22; H01Q 19/18; H01Q 19/10; H01Q 3/46; H01Q 7/00; H01Q 15/14; H01Q 21/26
See application file for complete search history.

(56) References Cited

U.S. PATENT DOCUMENTS 3,148,370 A 9/1964 Bowman
3,681,771 A 8/1972 Lewis et al.
(Continued)

FOREIGN PATENT DOCUMENTS

EP 1544963 A1 6/2005
JP 2001-36306 2/2001
(Continued)

OTHER PUBLICATIONS

Final Office Action for U.S. Appl. No. 15/693,139 dated Sep. 9, 2020.
(Continued)

*Primary Examiner* — Hoang V Nguyen
(74) *Attorney, Agent, or Firm* — Tarolli, Sundheim, Covell & Tummino LLP

(57) ABSTRACT

A reflectarray antenna system includes an antenna feed configured to at least one of transmit and receive a wireless signal occupying a frequency band. The system also includes a reflector having a reflectarray. The reflectarray includes a plurality of reflectarray elements, where each of the reflectarray elements includes a dipole element. The dipole element of at least a portion of the plurality of reflectarray elements comprises a crossed-dipole portion and a looped-dipole portion. The plurality of reflectarray elements can be configured to selectively phase-delay the wireless signal to provide the wireless signal as a coherent beam.

20 Claims, 5 Drawing Sheets

(51) Int. Cl.

| | |
|---|---|
| ***H01Q 1/38*** | (2006.01) |
| ***H01Q 3/46*** | (2006.01) |
| ***H01Q 7/00*** | (2006.01) |
| ***H01Q 19/10*** | (2006.01) |
| ***H01Q 21/26*** | (2006.01) |

(52) U.S. Cl.
CPC ..... *H01Q 15/14* (2013.01); *H01Q 19/10* (2013.01); *H01Q 21/26* (2013.01)

(56) References Cited

U.S. PATENT DOCUMENTS

| | | | | |
|---|---|---|---|---|
| 3,852,765 | A | 12/1974 | Bresler et al. | |
| 4,797,682 | A | 1/1989 | Klimczak | |
| 4,905,014 | A * | 2/1990 | Gonzalez | H01Q 15/0013 343/754 |
| 5,155,050 | A | 10/1992 | Bayraktaroglu | |
| 5,400,042 | A | 3/1995 | Tulintseff | |
| 5,459,123 | A | 10/1995 | Das | |
| 5,483,246 | A | 1/1996 | Barnett et al. | |
| 5,543,809 | A * | 8/1996 | Profera, Jr. | H01Q 3/46 343/756 |
| 5,892,485 | A | 4/1999 | Glabe et al. | |
| 6,147,647 | A | 11/2000 | Tassoudji et al. | |
| 6,211,835 | B1 * | 4/2001 | Peebles | H01Q 19/192 343/781 P |
| 6,366,184 | B1 | 4/2002 | Ohtonen | |
| 6,426,727 | B2 | 7/2002 | Gilbert | |
| 6,483,475 | B1 * | 11/2002 | Tokuda | H01Q 13/065 343/781 R |
| 6,501,426 | B2 | 12/2002 | Waterman | |
| 6,737,936 | B2 | 5/2004 | Noguchi | |
| 6,831,601 | B1 | 12/2004 | Lopez et al. | |
| 6,864,763 | B2 | 3/2005 | Brown et al. | |
| 6,967,624 | B1 | 11/2005 | Hsu et al. | |
| 6,999,034 | B1 | 2/2006 | Tsai et al. | |
| 7,034,771 | B2 * | 4/2006 | Rao | H01Q 25/007 343/781 R |
| 7,154,451 | B1 | 12/2006 | Sievenpiper | |
| 7,907,090 | B2 | 3/2011 | Bershadsky et al. | |
| 8,144,059 | B2 | 3/2012 | Lynch | |
| 8,217,847 | B2 | 7/2012 | Sotelo et al. | |
| 8,319,698 | B2 | 11/2012 | Legay et al. | |
| 8,508,319 | B1 | 8/2013 | Newsham et al. | |
| 8,665,040 | B1 | 3/2014 | Chappell et al. | |
| 8,736,505 | B2 | 5/2014 | Lambert et al. | |
| 10,256,545 | B2 | 4/2019 | Boryssenko et al. | |
| 10,547,118 | B2 | 1/2020 | Guntupalli et al. | |
| 10,892,549 | B1 | 1/2021 | Smith | |
| 10,944,164 | B2 | 3/2021 | Cooley et al. | |
| 11,075,456 | B1 | 7/2021 | Hennig et al. | |
| 2001/0050653 | A1 * | 12/2001 | Clancy | H01Q 3/46 343/909 |
| 2001/0054978 | A1 | 12/2001 | Adachi et al. | |
| 2003/0137456 | A1 | 7/2003 | Sreenivas et al. | |
| 2004/0004580 | A1 | 1/2004 | Toland et al. | |
| 2004/0046623 | A1 | 3/2004 | Brown et al. | |
| 2005/0285808 | A1 | 12/2005 | Holter | |
| 2006/0006966 | A1 | 1/2006 | Kang et al. | |
| 2006/0038732 | A1 | 2/2006 | Deluca et al. | |
| 2006/0232479 | A1 | 10/2006 | Walton | |
| 2007/0287634 | A1 | 12/2007 | Lin et al. | |
| 2008/0030416 | A1 | 2/2008 | Lee et al. | |
| 2008/0111757 | A1 | 5/2008 | Bisiules et al. | |
| 2008/0238790 | A1 | 10/2008 | McGrath et al. | |
| 2009/0079645 | A1 | 3/2009 | Sotelo et al. | |
| 2009/0091406 | A1 | 4/2009 | Kushta et al. | |
| 2009/0243762 | A1 | 10/2009 | Chen et al. | |
| 2010/0085272 | A1 | 4/2010 | Legay et al. | |
| 2010/0117903 | A1 | 5/2010 | Zheng | |
| 2010/0194629 | A1 | 8/2010 | Craig et al. | |
| 2010/0220036 | A1 * | 9/2010 | Maruyama | H01Q 3/46 343/912 |
| 2011/0059688 | A1 | 3/2011 | Noonan et al. | |
| 2012/0280872 | A1 | 11/2012 | Werner et al. | |
| 2013/0038495 | A1 | 2/2013 | Benzel et al. | |
| 2013/0214980 | A1 | 8/2013 | Lambert et al. | |
| 2013/0328635 | A1 | 12/2013 | Sekiguchi | |
| 2014/0218251 | A1 | 8/2014 | Waschenko et al. | |
| 2014/0231266 | A1 | 8/2014 | Sherrer et al. | |
| 2014/0285394 | A1 | 9/2014 | Truthan | |
| 2015/0162663 | A1 | 6/2015 | Boryssenko et al. | |
| 2015/0162665 | A1 | 6/2015 | Boryssenko et al. | |
| 2016/0164155 | A1 | 6/2016 | Wang et al. | |
| 2016/0211585 | A1 | 7/2016 | Chau et al. | |
| 2019/0013592 | A1 | 1/2019 | West et al. | |
| 2019/0020114 | A1 | 1/2019 | Paulotto et al. | |
| 2019/0260137 | A1 | 8/2019 | Watanabe et al. | |
| 2019/0279950 | A1 | 9/2019 | Kim et al. | |
| 2019/0319369 | A1 | 10/2019 | Chiang et al. | |
| 2020/0106158 | A1 | 4/2020 | Gomez Angulo et al. | |
| 2020/0106178 | A1 | 4/2020 | Chou | |
| 2020/0112081 | A1 | 4/2020 | Kim et al. | |
| 2020/0185826 | A1 | 6/2020 | Park et al. | |

FOREIGN PATENT DOCUMENTS

| | | |
|---|---|---|
| JP | 2014-527474 A | 10/2014 |
| WO | 2014/117259 A1 | 8/2014 |

OTHER PUBLICATIONS

Non Final Office Action for U.S. Appl. No. 15/693,139 dated Apr. 17, 2020.

European Search Report for Application No. 17 151 950.7-1205 dated Jul. 22, 2019.

Entesari Kam Ran et al: 11 Tunab le SIW Structures: Antennas, VCOs, and Filters, IEEE Microwave Magazine, IEEEService Center, Piscataway, NJ, US, vol. 16, No. 5, Jun. 1, 2015 (Jun. 1, 2015),pp. 34-54, XP011580297, ISSN: 1527-3342, DOI: 10.1109/MMM.2015.2408273 [retrieved on May 6, 2015] * p. 49,; figure 10 *.

European Search Report for Application No. 20157215.3-1205 dated Jun. 29, 2020.

Non Final Office Action for U.S. Appl. No. 16/352,489 dated Jul. 7, 2020.

Church, Additive Manufacturing: The Next Frontier for Research, Business and Opportunity, NSF workshop on Frontiers of Additive manufacturing Research and education, U.S., National Science Foundation, Jul. 12, 2013, pp. 1-27, URL, http://nsfam.mae.ufl.edu/Slides/Church.pdf.

Japanese Office Action corresponding to Japanese Application No. 2018-510348 dated Feb. 26, 2019.

European Examination Report corresponding to European Application No. 16754100.2 dated Feb. 27, 2019.

Final Office Action for U.S. Appl. No. 15/693,139 dated Feb. 23, 2021.

International Search Report for Application No. PCT/US2020/059573 dated Feb. 22, 2021.

Israeli Office Action for Application No. 257201 dated Apr. 21, 2021.

Israeli Office Action for Application No. 257201 dated Jun. 21, 2021.

Joel D Barrera et al: "Analysis of a Variable SIW Resonator Enabled by Dielectric Material Perturbations and Applications", IEE Transactions on Microwave Theory and Techniques, IEEE Service Center, Piscataway, NJ, US, vol. 61, No. I, Jan. 1, 2013 (Jan. 1, 2013), pp. 225-233, XPOI1488059, ISSN: 0018-9480, DOI: 10.1109,TMTT.2012.2226052 *Fig. 3 and B. Variable SIW Resonator at pp. 226-227*.

Park J et al: "Low-loss, tunable microwave capacitors using bismuth zinc niobate thin films", Applications of Ferroelectrics, 2004. ISAF-04. 2004 14th IEEE International Symposium on Montreal, Canada Aug. 23-27, 2004, Piscataway, NJ, USA, IEEE, Aug. 23, 2004 (204-08-23), pp. 17-20, XP010784487, DOI:10.1109/ISAF.2004.1418327 ISBN: 978-0-7803-8410-1 *abstract; figure 1*.

Topalli, et al.: "A Monolithic Phased Array Using 3-Bit Distributed RF MEMS Phase Shifters"; Microwave Theory and Techniques, IEEE Transactions on 56.2 (2008): 270-277.

(56) References Cited

OTHER PUBLICATIONS

Kenneth Church: "Additive Manufacturing: The Next Frontier for Research, Business and Opportunity". NSF Workship on Frontiers o Addivive Manufacturing Research and Education, Jul. 12, 2013 (Jul. 12, 2013), pp. 1-27, XP055315495. Arlington, VA, USA Retrieved from the Internet: URL: http://nsfam.mae.ufl.edu/Slides/Church.pdf [retrieved on Nov. 1, 2016] pp. 16, 20 and 26.

Mohd Ghazali et al: "Affordable 3D printed microwave antennas", 2015 IEEE 65th Electronic Components and Technology Conference (ECTC), May 26, 2015 (May 26, 2015), pp. 240-246, XP055310432, DOI: 10.1109/ECTC.2015.7159599, section IV. b.; p. 244-p. 245; figures 16-20.

Huang Guan-Long et al: "3-D metal-direct-printed wideband and high-efficiency waveguide-fed antenna array", The Institute of Electrical and Electronics Engineers, Inc. (IEEE) Conference Proceedings, May 1, 2015 (May 1, 2015), p. 1, XP055310499, Piscataway, sections I.-III.; p. 1-p. 2; figures 1, 2.

* cited by examiner

REFLECTARRAY ANTENNA SYSTEM

RELATED APPLICATIONS

This application is a divisional application of, and claims priority to, co-pending U.S. nonprovisional patent application Ser. No. 14/054,267, filed 15 Oct. 2013, which is incorporated herein in its entirety.

GOVERNMENT INTEREST

This invention was made with Government support. The Government has certain rights in this invention.

TECHNICAL FIELD

The present invention relates generally to wireless systems, and specifically to a reflectarray antenna system.

BACKGROUND

Communications terminals, radar sensors, and other wireless systems with antennas can be employed for a wide variety of applications. The associated platforms can be space-based (e.g. satellite), airborne, or terrestrial. Some radar and communication system applications require large antennas, and can thus occupy a large volume on the platform on which they are implemented. Some radar and communication systems can employ multiple frequency bands to provide enhanced sensing, such as for radar, or increased data capacity, such as for communications. For example, separate frequency bands can be employed for communicating with different transceivers, or can be employed for separate uplink and downlink communications. Different frequency bands are typically accommodated by using additional hardware, i.e. separate antennas and RF electronics for each band.

SUMMARY

One embodiment describes a reflectarray antenna system. The system includes an antenna feed configured to at least one of transmit and receive a wireless signal occupying a frequency band. The system also includes a reflector comprising a reflectarray. The reflectarray includes a plurality of reflectarray elements, where each of the reflectarray elements includes a dipole element. The dipole element of at least a portion of the plurality of reflectarray elements comprises a crossed-dipole portion and a looped-dipole portion. The plurality of reflectarray elements can be configured to selectively phase-delay the wireless signal to provide the wireless signal as a coherent beam.

Another embodiment includes a method for providing dual-band wireless transmission via a reflectarray antenna system. The method includes one of transmitting and receiving a first wireless signal occupying a first frequency band between a first antenna feed and a reflector comprising a plurality of reflectarray elements selectively distributed on the reflector. The plurality of reflectarray elements can have a geometry that is substantially transparent with respect to the first frequency band. The method also includes one of transmitting and receiving a second wireless signal occupying a second frequency band between a second antenna feed and the reflector. The geometry of the plurality of reflectarray elements can provide selective phase-delay of the second wireless signal to provide a coherent beam associated with the second wireless signal.

Another embodiment includes a reflectarray antenna system. The system includes a first antenna feed configured to at least one of transmit and receive a first wireless signal occupying a first frequency band. The system also includes a second antenna feed configured to at least one of transmit and receive a second wireless signal occupying a second frequency band. The system further includes a reflector comprising a reflectarray and being configured to provide the first wireless signal and the second wireless signal as a first coherent beam and a second coherent beam, respectively. The reflectarray can be configured to selectively phase-delay at least one of the first and second wireless signals to provide the respective at least one of the first and second coherent beams.

DETAILED DESCRIPTION

The present invention relates generally to wireless systems, and specifically to a reflectarray antenna system. A reflectarray antenna system can include an antenna feed that is configured to transmit and/or receive a wireless signal that occupies a first frequency band, and a reflector that includes a reflectarray. The reflectarray includes a plurality of reflectarray elements that is configured to provide selective phase-delays of the wireless signals to provide a collimated beam corresponding to the wireless signal. The reflector can be configured as a flat surface, or can be curved (e.g., parabolic) along a single dimension or two dimensions, such that the reflectarray elements can provide selective phase-delays of the wireless signal to substantially emulate various types of single or multi-reflector systems, such as Cassegrain or Gregorian antenna architectures. At least a portion of the reflectarray elements can each include a dipole element that includes a crossed-dipole portion and a looped-dipole portion, such that the reflectarray elements can provide phase delays of greater than 360°, and can achieve significant gain and pattern performance improvements relative to typical reflectarrays.

In providing the selective phase delays, the reflectarray elements can provide the wireless signal as a coherent beam. As an example, the plurality of reflectarray elements can each have a variable dimension and geometry with respect to each other, such that the reflectarray elements can be transparent to wireless signals of certain wavelengths and can provide the selective phase-delays to wireless signals of other wavelengths. Accordingly, the reflectarray antenna system can provide dual-band wireless transmission substantially concurrently in each of a first frequency band and a second frequency band, such as in a satellite communication platform, with substantially reduced hardware to provide a more compact and more cost effective communication platform.

For example, the reflectarray antenna system can include a second antenna feed that is configured to transmit and/or receive a second wireless signal that occupies a second frequency band. As an example, the first frequency band can be Ka-band (e.g., approximately 35 GHz) and the second frequency band can be W-band (e.g., approximately 94 GHz). The reflectarray can be configured to provide selective phase-delays of at least one of the first and second wireless signals to provide a coherent beam for the first and/or second wireless signal. For example, the reflectarray elements can be transparent with respect to the first wireless signal and can provide the selective phase delays to the second wireless signal.

Figure 1:
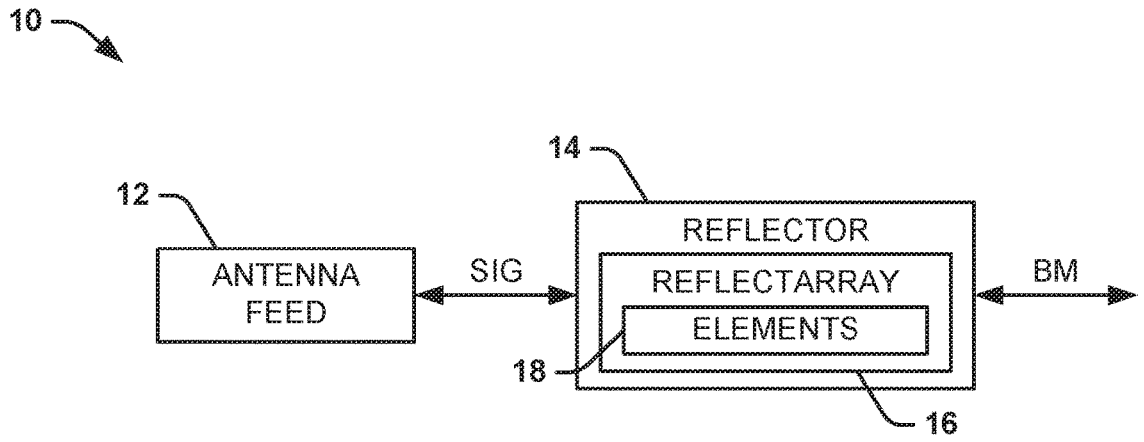
FIG. 1 illustrates an example of a reflectarray antenna system.

FIG. 1 illustrates an example of a reflectarray antenna system 10. The reflectarray antenna system 10 can be implemented in a variety of different wireless applications, such as satellite or other long-range wireless communications, radar, or a variety of other applications. The reflectarray antenna system 10 includes an antenna feed 12 that can be configured to transmit and/or receive a wireless signal SIG. As an example, the reflectarray antenna system 10 can be implemented to transmit the wireless signal SIG from a transmitter (not shown), and/or can be implemented to receive the wireless signal SIG to be provided to a respective receiver (not shown).

The wireless signal SIG is provided to a reflector 14, such that the reflector 14 reflects the wireless signal SIG to or from the antenna feed 12. As an example, the wireless signal SIG can be provided from the antenna feed 12 to be reflected from the reflector 14 to form a collimated beam BM that is provided in a prescribed angular direction. As another example, the beam BM can be received and reflected from the reflector 14 to the antenna feed 12 as the signal SIG. The reflection of the wireless signal SIG between the reflector 14 and the antenna feed 12 can occur via a sub-reflector (not shown), such that the energy of the wireless signal SIG can be optimally distributed on the reflector 14 to provide the collimated beam BM as a coherent beam for the wireless signal SIG at the reflector 14, as described herein.

In the example of FIG. 1, the reflector 14 includes a reflectarray 16 that is configured to interact with the transmitted wireless signal SIG or the received beam BM to provide selective phase-delay of the respective transmitted wireless signal SIG or the received beam BM. In the example of FIG. 1, the reflectarray 16 includes a plurality of reflectarray elements 18 that are selectively distributed across the reflector 14. The reflectarray elements 18 can have variable geometry and dimensions across the selective distribution, such that the reflectarray elements 18 can provide the selective phase-delay based on the respective geometry and dimensions. As an example, at least a portion of the reflectarray elements 18 can include a dipole element that includes a crossed-dipole portion and a looped-dipole portion that surrounds the crossed-dipole portion, as described in greater detail herein. For example, the reflectarray elements 18 can be provided in a distribution of reflectarray elements 18 that include a dipole element having only the crossed-dipole portion, and a distribution of reflectarray elements 18 that include a hybrid dipole element that includes the crossed-dipole portion and the looped-dipole portion that surrounds the crossed-dipole portion.

Additionally, such distribution of reflectarray elements 18 can have a state (i.e., dimensional size and/or geometric characteristics) distribution that is provided in a substantially uniform state pattern distribution (e.g., as partial or full loops). As described herein, "substantially uniform state pattern distribution" describes a distribution of the states of the reflectarray elements 18 in a manner that is provided as patterns of approximate uniformity with respect to the states of individual reflectarray elements 18, such as with respect to multiple types of dipole elements associated with each of the reflectarray elements 18, over the surface of the reflector 16. Thus, the reflectarray elements 18 can provide a coherent beam for the wireless signal SIG between the reflector 14 and the antenna feed 12, regardless of the geometry of the reflector 14. For example, the surface of the reflector 14 can be a flat surface or can be curved in one or two dimensions. Therefore, the reflectarray 16 can provide the wireless signal SIG as the collimated beam BM with a desired wavefront, or can provide the received beam BM as the wireless signal SIG to the antenna feed 12, such that the antenna feed 12 can be located off-focus (i.e., offset-fed) from the reflector 14.

Figure 2:
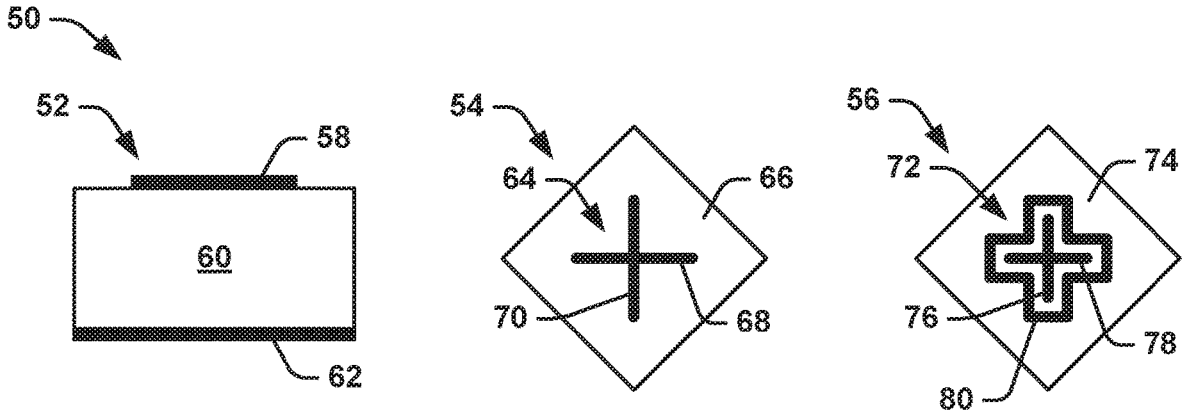
FIG. 2 illustrates an example diagram of reflectarray elements.

FIG. 2 illustrates an example diagram 50 of reflectarray elements. The diagram 50 includes a side-view of a reflectarray element 52, a top-view of a reflectarray element 54, and a top-view of a reflectarray element 56. The reflectarray elements 52, 54, and 56 can be implemented as the reflectarray elements 18 in the reflectarray 16 in the example of FIG. 1. Therefore, reference is to be made to the examples of FIG. 1 in the following description of the example of FIG. 2.

The reflectarray element 52 includes a dipole element 58 disposed on a substrate 60 that is layered over a ground plane 62. As an example, the dipole element 58 and the ground plane 62 can each be formed of a conductive material (e.g., copper), and the substrate 60 can be a dielectric material. The conductive material can thus be deposited onto the dielectric 60 using any of a variety of processing techniques and can be etched to form the dipole element 58.

The reflectarray element 54 includes a dipole element 64 disposed over a substrate 66. The reflectarray element 54 can correspond to the reflectarray element 52, such that the substrate 66 can overlay a conductive ground plane. The substrate 66 can correspond to a unit cell for the reflectarray element 54, such that each reflectarray element can be fabricated on an area of substrate that is approximately equal with respect to each other, such as all reflectarray elements that are fabricated together on a wafer during a fabrication process. The dipole element 64 is demonstrated in the example of FIG. 2 as a crossed-dipole portion. In the example of FIG. 2, the dipole element 64 arranged as a crossed-dipole portion includes a contiguous conductive portion arranged as a pair of orthogonal intersecting strips 68 and 70 that have a defined perimeter. For example, the orthogonal intersecting strips 68 and 70 can have a substantially equal length and width, where the width defines the perimeter, and can substantially bisect each other. The reflectarray element 54 can be fabricated with a variable length for each of the strips 68 and 70, such that the length of the strips 68 and 70 can define a phase shift of the reflected field of the wireless signal SIG.

The reflectarray element 56 includes a dipole element 72 disposed over a substrate 74. The reflectarray element 56 can correspond to the reflectarray element 52, such that the substrate 74 can overlay a conductive ground plane. Similar to the reflectarray element 56, the substrate 74 can correspond to a unit cell for the reflectarray element 56. The dipole element 72 is demonstrated in the example of FIG. 2 as including a crossed-dipole portion and a looped-dipole portion. In the example of FIG. 2, the crossed-dipole portion of the dipole element 72 includes a first contiguous conductive portion arranged as a pair of orthogonal intersecting strips 76 and 78 that have a defined perimeter. The looped-dipole portion of the dipole element 72 includes a second contiguous conductive portion arranged as a loop 80 that extends around the strips and which has a perimeter that is concentric with respect to the perimeter of the strips 76 and 78. Thus, the looped-dipole portion of the dipole element 72 is demonstrated as a crossed-loop dipole portion. For example, the strips 76 and 78 can have an approximately equal length and can substantially bisect each other. The strips 76 and 78 and the loop 80 can have an approximately equal width, and the loop 80 can be spaced apart from each end of the strips 76 and 78 and along each point of the strips 76 and 78 by an approximately equal distance. Similar to as described previously regarding the reflectarray element 54, the reflectarray element 56 can be fabricated with a variable length for each of the strips 76 and 78, and thus size of the loop 80, to define a phase shift of the reflected field of the wireless signal SIG.

Based on including a distribution of both the reflectarray elements 54 (i.e., each including the dipole element 64) and the reflectarray elements 56 (i.e., each including the dipole element 72) on a given reflector, the distribution of the reflectarray elements 54 and 56 can exhibit substantially improved performance characteristics with respect to incident radio frequency (RF) radiation relative to a distribution of other types of reflectarray elements. As one example, based on a set of dimensions of the dipole elements 64 and 72, the distribution of the reflectarray elements 54 and 56 can exhibit greater than 360° of phase-shift over a wide range of incident angles for both transverse electric (TE) and transverse magnetic (TM) polarizations. In addition, the reflectarray elements 54 and 56 can be fabricated on a single substrate layer, and can exhibit improved (i.e., less) absorption and phase error losses relative to other types of reflectarray elements fabricated with multiple layers. For example, the state pattern distribution of the reflectarray elements 54 and 56 can achieve substantially improved gain and bandwidth relative to traditional reflectarray element designs, and can be more robust to fabrication tolerance variations with respect to the dipole elements 64 and 72 over the surface of the associated reflector.

Figure 3:
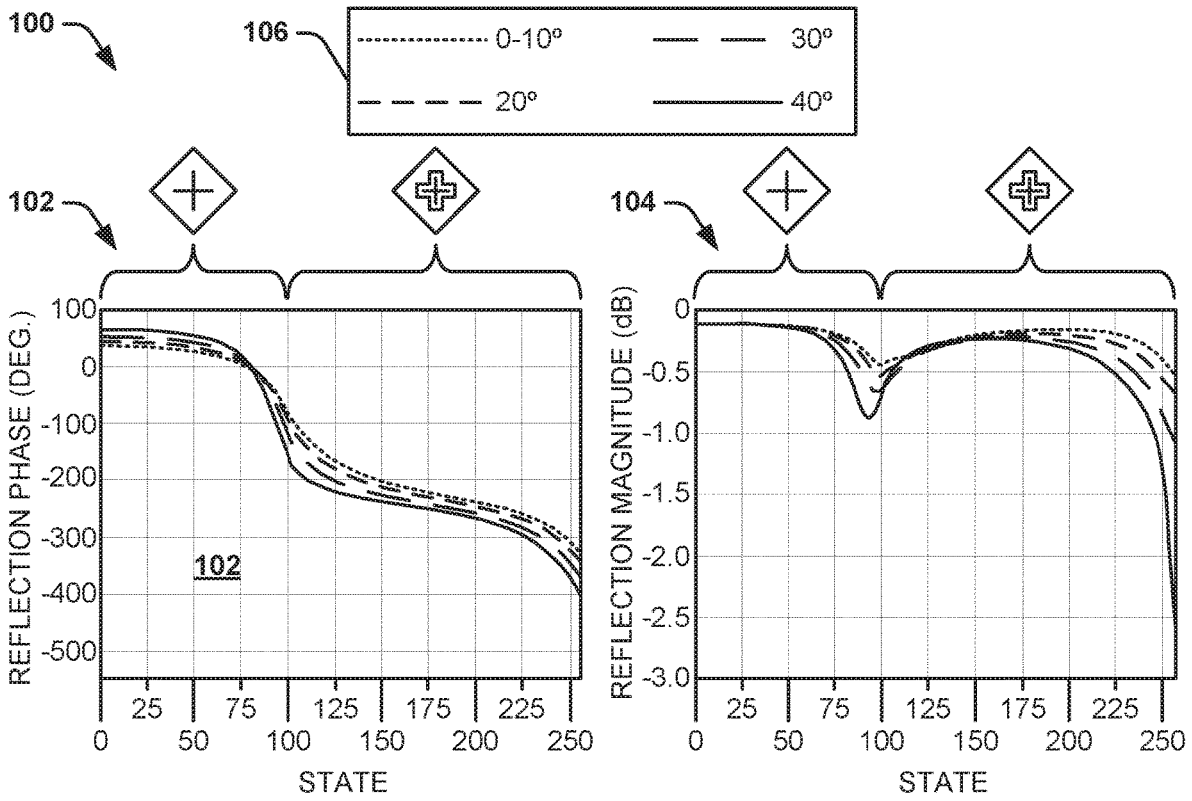
FIG. 3 illustrates an example diagram of graphs depicting RF performance characteristics of reflectarray elements.

FIG. 3 illustrates an example diagram 100 of graphs depicting performance characteristics of a reflectarray that implements a distribution of the reflectarray elements 54 and 56. The diagram 100 includes a first graph 102 that depicts phase shift in degrees as a function of dipole element state (e.g., dimensional size), and a second graph 104 that depicts reflection magnitude as a function of the dipole element state. In the example of FIG. 3, the reflectarray elements 54 and 56 can be tuned to provide selective phase-shift of a frequency of approximately 94 GHz (i.e., W-band). In the example of FIG. 3, a total of 256 unique element states are provided by a combined usage of reflectarray elements 54 and reflectarray elements 56. As demonstrated in the example of FIG. 3, the states up to approximately one-hundred are associated with the reflectarray elements 54, and the states that are greater than approximately one-hundred are associated with the reflectarray elements 56.

As demonstrated by the first graph 102, the reflectarray elements 54 and 56 can provide greater than 360° of phase excursion for both TE and TM polarizations across a broad range of incidence angles, demonstrated in a legend 106 as between 0° and 40°. Because short phase-shifts can be realized by the reflectarray element 54, and larger phase shifts can be realized by the reflectarray elements 56, the reflectarray (e.g., the reflectarray 16) can incorporate a selective distribution of both the reflectarray elements 54 and 56 to provide a selected reflection phase distribution across the surface of the associated reflector to form a prescribed beam. In addition, as demonstrated by the second graph 104, the reflectarray element 56 can exhibit substantially lower losses relative to traditional reflectarray elements (e.g. single element designs such as crossed-dipoles, rings, and/or microstrip patches), such as based on having a substantially uniform dipole element state pattern distribution across the reflector, as opposed to having a distribution of one type of reflectarray element across an associated reflector.

Referring back to the example of FIG. 2, the geometry of the dipole elements 64 and 72 can also be tuned to be transparent to a given set of frequency bands, and adds little to no additional difficulty or cost to fabricate than other types of dipole elements that implement crossed-dipole arrangements, rings, microstrip patches, or other types of dipole elements, and can be easier and more cost effective to fabricate than reflectarray elements that are fabricated with multiple layers. Therefore, based on the desired performance of a given reflectarray element of the reflectarray 16 and the respective frequency band of the wireless signal SIG, the reflectarray 16 can include a selective distribution of the reflectarray elements 54 and 56, with each of the reflectarray elements 54 and 56 having respective dipole elements 64 and 72 that are dimensioned to provide a given phase-shift for the respective portion of the wireless signal SIG to provide a coherent beam associated with the wireless signal SIG.

It is to be understood that the reflectarray elements 54 and 56 are not intended to be limited to the example of FIG. 2. As an example, the crossed-dipole portion of the dipole elements 64 and/or 72 are not limited to the strips 68 and 70 and/or the strips 76 and 78, respectively, having approximately equal length and/or limited to substantially bisecting each other. As another example, the crossed-loop dipole element 72 is not limited to being substantially concentric and/or equidistant with respect to the perimeter of the crossed-dipole portion, but could instead have a perimeter that is arranged as other types of geometries, such as a square, circle, or other types of substantially looped arrangements. Furthermore, because the dipole elements 64 and 72 associated with the reflectarray elements 54 and 56 can be dimensioned to be transparent with respect to a given one or more frequency bands, the associated reflector can be implemented to reflect two or more wireless signals concurrently, as described in greater detail herein.

Figure 4:
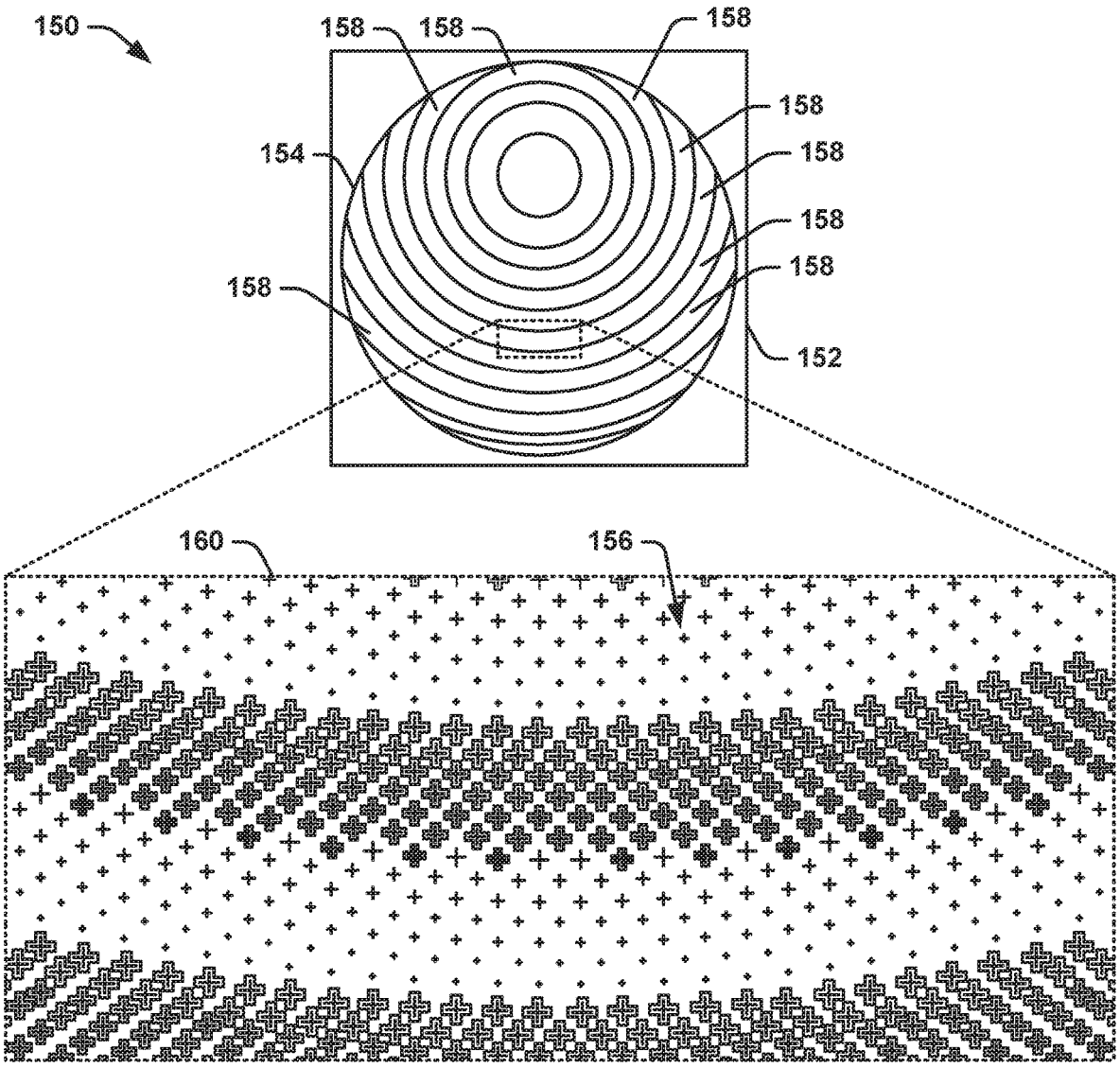
FIG. 4 illustrates an example diagram of an antenna reflector.

FIG. 4 illustrates an example diagram 150 of an antenna reflector 152. The antenna reflector 152 can correspond to the reflector 14 in the example of FIG. 1. Therefore, reference is to be made to the example of FIGS. 1 and 2 in the following description of the example of FIG. 4.

The antenna reflector 152 includes a reflectarray 154 disposed on the reflection surface, such as corresponding to the reflectarray 16 in the example of FIG. 1. Therefore, the reflectarray 154 can be configured to provide selective phase-delay and coherent beam formation of the wireless signal SIG. The reflectarray 154 is demonstrated in the example of FIG. 4 as including a plurality of reflectarray elements 156 that are selectively distributed in a plurality of at least partial loops 158, as demonstrated in the exploded view 160. The reflectarray elements 156 includes an assortment of reflectarray elements that include a crossed-dipole portion only (e.g., the crossed-dipole element 64) and an assortment of reflectarray elements that include both a crossed-dipole portion and a looped-dipole portion (e.g., the crossed-loop dipole element 72).

In the example of FIG. 4, the reflectarray elements 156 that include both a crossed-dipole portion and a looped-dipole portion are arranged closer to an inner portion of each of the loops 158 and can achieve higher phase states, while the reflectarray elements 156 that include only the crossed-dipole portion are arranged closer to an outer portion of each of the loops 158 and have lower phase states. In the example of FIG. 4, the states associated with reflectarray elements 156 in a given one of the loops 158 are arranged in a decreasing gradient of dimensions from an inner portion of a given loop 158 to an outer portion of the given loop 158. As an example, the varying dimensions can be based on a respective length of the crossed-dipole portion strips (e.g., the strips 118 and 120 and/or the strips 126 and 128). Therefore, the example of FIG. 4 demonstrates that the reflectarray elements 156 are distributed across the reflector in a substantially uniform state pattern distribution with respect to multiple types of dipole elements (e.g., the dipole elements 64 and 72), as opposed to typical reflectarrays that implement a single type of dipole element for each reflectarray element distributed across the associated reflector. As a result, the reflectarray 154 can exhibit substantially less absorption and phase losses for an incident signal through which phase-shifts occur than for typical reflectarrays. In other words, because the states of the dipole elements of the respective reflectarray elements 156 are distributed in the substantially uniform state pattern distribution across the surface of the antenna reflector 152, the states of the separate types of dipole elements are distributed in a more uniform manner across the entire surface of the antenna reflector 156. As a result, the states of the dipole elements are not concentrated about the resonance states of the associated wireless signal at more concentrated portions of the antenna reflector 152, such as in typical reflectarray systems. Accordingly, the absorption and phase losses associated with the reflectarray 154 can be substantially mitigated relative to typical reflectarray systems.

The arrangement of the reflectarray elements 156 regarding the type of dipole portions and the dimensions of the dipole portions with respect to the loops 158 can be set to provide a selected reflection phase distribution across the surface of the reflector to form a prescribed beam. For example, the surface of the antenna reflector 152 can be a flat surface or can be curved in one or two dimensions. Therefore, the arrangement of the reflectarray elements 156 can provide coherent beam formation for a wireless signal (e.g., the wireless signal SIG) using the reflectarray 154 and an associated antenna feed (e.g., the antenna feed 12). In addition, the dipole portions of the reflectarray elements 156 can be dimensioned such that the dipole portions of the reflectarray elements 156 are transparent to a set of frequency bands, such that a given wireless signal occupying the frequency band does not experience phase-delays. Accordingly, the reflectarray 154 can be configured in a variety of ways to also provide dual-band wireless operation, as described in greater detail herein.

Figure 5:
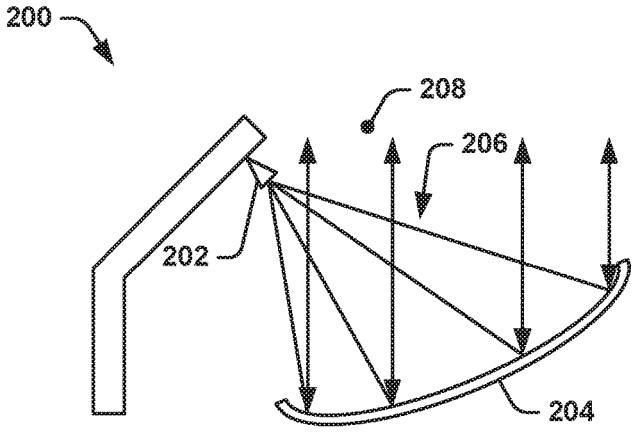
FIG. 5 illustrates an example of a reflector/reflectarray antenna assembly.

FIG. 5 illustrates an example of a reflector/reflectarray antenna assembly 200. The reflector/reflectarray antenna assembly 200 includes an antenna feed 202 and a reflector 204. The reflector 204 includes a reflectarray (not shown) comprising reflectarray elements disposed across the surface. Thus, the reflector 204 can be configured substantially similar to the reflector 152 in the example of FIG. 4. In the example of FIG. 5, while the antenna feed 202 is a direct feed with respect to the reflector 204, it is to be understood that the reflector/reflectarray antenna assembly 200 could also include a sub-reflector interposed between the antenna feed 202 and the reflector 204. As an example, the sub-reflector can likewise include a reflectarray that is configured substantially similar to the reflectarray 154 in the example of FIG. 4. Additionally, while the antenna feed 202 is demonstrated as a horn feed, it is to be understood that the antenna feed 202 can be configured instead as a different type of antenna feed, such as an active electronically scanned array (AESA). Furthermore, in the example of FIG. 5, the reflector 204 is demonstrated as parabolic. As one example, the reflector 204 can be parabolic or curved in one dimension, such as for implementation with an AESA antenna feed, or could be curved in one or two dimensions. However, the reflector 204 could instead be configured as a flat surface, or any of a variety of other shapes and dimensions (e.g., curved outward or convex).

The antenna feed 202 can be configured to transmit and/or receive a wireless signal 206, such that the reflector 204 reflects the wireless signal 206 to or from the antenna feed 202. As an example, the wireless signal 206 can be provided from the antenna feed 202 to be reflected from the reflector as a collimated beam that is provided in a prescribed angular direction. As another example, the received beam can be reflected from the reflector 204 to the antenna feed 202 as the wireless signal 206. In the example of FIG. 5, the antenna feed 202 is demonstrated as located off-focus from a focal point (or focal axis) 208 of the reflector 204. The reflectarray disposed on the reflector 204 is configured to interact with the transmitted wireless signal 206 to provide selective phase-delay of the wireless signal 206. Thus, despite the offset of the antenna feed 202 from the focal point 208 of the reflector 204, the reflectarray can provide a coherent beam for the wireless signal 206 that is focused at the antenna feed 202. Therefore, the reflectarray can provide the wireless signal 206 as a collimated beam with a desired wave front, or can provide a received beam as the wireless signal 206 at the antenna feed 202.

Figure 6:
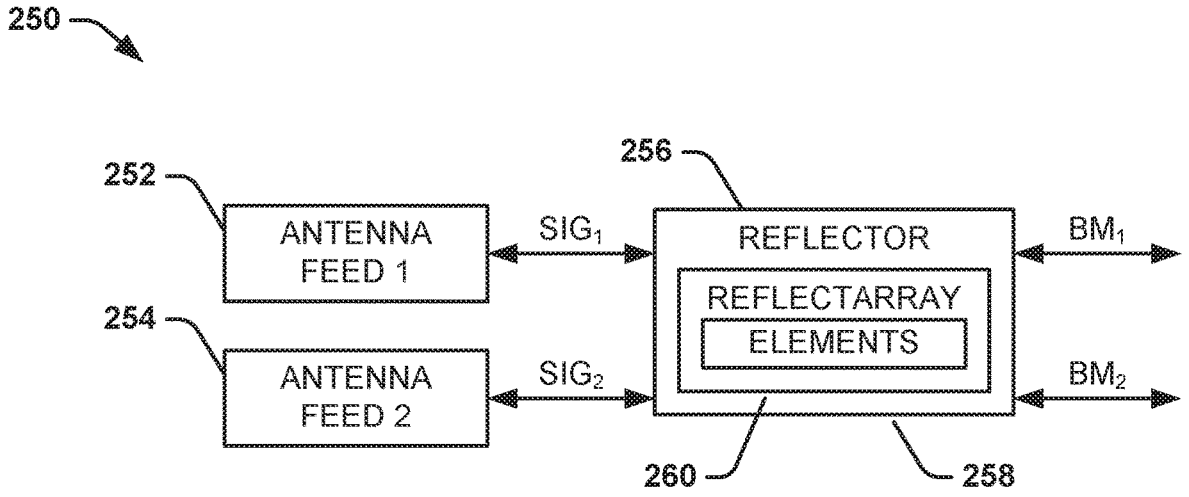
FIG. 6 illustrates another example of a reflectarray antenna system.

As described previously, the reflectarray antenna system can be implemented to provide dual-band wireless functionality. FIG. 6 illustrates an example of a reflectarray antenna system 250. The reflectarray antenna system 250 can be implemented in a variety of different wireless applications, such as satellite or other long-range wireless communications, radar, or a variety of other applications. The reflectarray antenna system 250 includes a first antenna feed 252 and a second antenna feed 254. The first antenna feed 252 can be configured to transmit and/or receive a first wireless signal $SIG_1$, and the second antenna feed 254 can be configured to transmit and/or receive a second wireless signal $SIG_2$. As an example, the reflectarray antenna system 250 can be implemented to transmit one or both of the wireless signals $SIG_1$ and $SIG_2$ from transmitters (not shown), and/or can be implemented to receive one or both of the wireless signals $SIG_1$ and $SIG_2$ to be provided to respective receivers (not shown). The first and second wireless signals $SIG_1$ and $SIG_2$ can each occupy separate frequency bands. For example, the first wireless signal $SIG_1$ can occupy the Ka-band (e.g., 35 GHz) and the second wireless signal $SIG_2$ can occupy the W-band (e.g., 94 GHz).

Each of the first and second wireless signals $SIG_1$ and $SIG_2$ are provided to a reflector 256, such that the reflector 256 reflects both of the first and second wireless signals $SIG_1$ and $SIG_2$ to or from the first and second antenna feeds 252 and 254, respectively. As an example, the first and second wireless signals $SIG_1$ and $SIG_2$ can be provided from the respective first and second antenna feeds 252 and 254 to form respective first and second collimated beams $BM_1$ and $BM_2$, which can be provided from the reflector 256 substantially concurrently. As another example, received first and second beams $BM_1$ and $BM_2$ can be received and reflected from the reflector 256 to the respective first and second antenna feeds 252 and 254 as the first and second wireless signals $SIG_1$ and $SIG_2$. The reflection of the first and second wireless signals $SIG_1$ and $SIG_2$ between the reflector 256 and the respective first and second antenna feeds 252 and 254 can occur via respective first and second sub-reflectors (not shown), such that the energy of the first and second wireless signals $SIG_1$ and $SIG_2$ can be optimally distributed on the reflector 256 to provide at least one of the first and second wireless signals $SIG_1$ and $SIG_2$ as a respective coherent beam, as described herein.

In the example of FIG. 6, the reflector 256 includes a reflectarray 258 that is configured to interact with at least one of the first and second wireless signals $SIG_1$ and $SIG_2$ to provide selective phase-delay of the respective at least one of the first and second wireless signals $SIG_1$ and $SIG_2$. As an example, the reflectarray 258 can include a plurality of reflectarray elements 260 that are selectively distributed across the reflector 256, such as similar to the reflectarray 154 in the example of FIG. 4. The reflectarray elements 260 can have variable geometry and dimensions across the selective distribution, such that the reflectarray elements 260 can provide the selective phase-delay based on the respective geometry and dimensions of the respective dipole elements. Thus, the reflectarray elements 260 can provide a coherent beam for at least one of the given at least one of the first and second wireless signals $SIG_1$ and $SIG_2$ between the reflector 256 and the respective at least one of the antenna feeds 252 and 254, regardless of the geometry of the reflector 256. For example, the surface of the reflector 256 can be a flat surface or can be curved in one or two dimensions.

As an example, the reflectarray elements 260 of the reflectarray 258 can have respective dimensions and geometry that are selected to be transparent to the first wireless signal $SIG_1$ and to provide the selective phase delays to the second wireless signal $SIG_2$. Therefore, the first antenna feed 252 can be dimensioned and configured differently with respect to the second antenna feed 254 while still providing for common reflection from the reflector 256. For example, the first antenna feed 252 can be located at an approximate focal point of the reflector 256, while the second antenna feed 254 is located off-focus from the reflector 256. As another example, the first antenna feed 252 can be configured as an AESA and the second antenna feed 254 can be configured as a horn antenna, and the reflector 256 can be configured as curved in one dimension. Thus, the first wireless signal $SIG_1$ can be scanned across the reflector 256 (e.g., via a sub-reflector that is curved in one dimension) to provide a coherent beam for the first wireless signal $SIG_1$. However, based on the geometry and distribution of the reflectarray elements 260 of the reflectarray 258, the second wireless signal $SIG_2$ can be provided incident on the reflector 256 (e.g., via a sub-reflector that is curved in two-dimensions), such that the reflectarray elements provide the selective phase-delay at respective portions of the reflector 256 to provide a coherent beam for the second wireless signal $SIG_2$.

Figure 7:
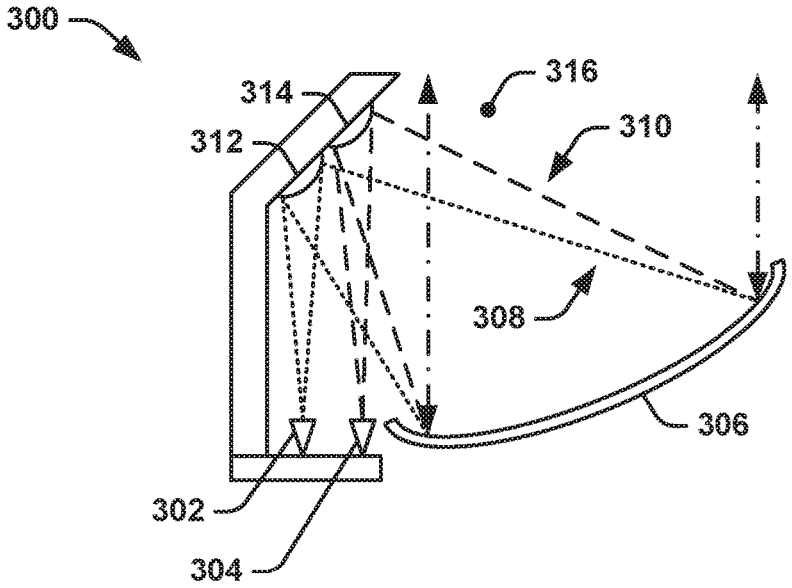
FIG. 7 illustrates another example of a reflector/reflectarray antenna assembly.

FIG. 7 illustrates an example of a reflector/reflectarray antenna assembly 300. The reflector/reflectarray antenna assembly 300 includes a first antenna feed 302, a second antenna feed 304 and a reflector 306. The first antenna feed 302 can be configured to transmit and/or receive a first wireless signal 308 (e.g., the wireless signal $SIG_1$), such as occupying the Ka-band (e.g., 35 GHz). The second antenna feed 304 can be configured to transmit and/or receive a second wireless signal 310 (e.g., the wireless signal $SIG_2$), such as occupying the W-band (e.g., 94 GHz). The reflector 306 includes a reflectarray (not shown) comprising reflectarray elements disposed across the surface. Thus, the reflector 304 can be configured substantially similar to the reflector 152 in the example of FIG. 4. Additionally, in the example of FIG. 7, the reflector/reflectarray antenna assembly 300 includes a first sub-reflector 312 configured to reflect the first wireless signal 308 between the first antenna feed 302 and the reflector 306 and a second sub-reflector 314 configured to reflect the second wireless signal 310 between the second antenna feed 304 and the reflector 306.

The reflectarray that is disposed on the surface of the reflector 306 can be transparent with respect to the first wireless signal 308. As an example, the first antenna feed 302 can be configured as an AESA that scans the first wireless signal 308 across the curved first sub-reflector 312 to reflect the first wireless signal 308 onto the reflector 306 in a sequence to form a first collimated beam in a prescribed angular direction. As another example, the second antenna feed 304 can be configured as a horn antenna feed to provide the second wireless signal 310 onto a curved (e.g., convex) sub-reflector to provide the second wireless signal 310 onto the reflectarray disposed on the surface of the reflector 306. Thus, the reflectarray can provide selective phase-delays of the respective portions of the second wireless signal 310 to form a second collimated beam in a prescribed angular direction substantially concurrently with the first collimated beam. Thus, the second antenna feed 304 can be located off-focus from a focal point (or focal axis) 316 of the reflector 306. Therefore, despite the offset of the antenna feed 304 from the focal point 316 of the reflector 306, the reflectarray can provide a coherent beam for the wireless signal 310. While the first and second sub-reflectors 312 and 314 are demonstrated as curved, the first and second sub-reflectors 312 and 314 can likewise include a reflectarray that is configured substantially similar to the reflectarray 154 in the example of FIG. 4, such that the first and second sub-reflectors 312 and 314 can have a variety of other geometries. Furthermore, while the reflector 306 is demonstrated as curved in the example of FIG. 7, the reflector 306 can instead be configured as a flat surface, or any of a variety of other dimensions (e.g., curved or convex).

Therefore, based on the arrangement of the reflectarray on the reflector 306, the reflector 306 can operate to concurrently reflect both the first wireless signal 308 and the second wireless signal 310, regardless of the arrangements of the respective first and second antenna feeds 302 and 304. Therefore, the reflectarray antenna system 300 in the example of FIG. 7 can implement dual-band wireless signal transmission in a much smaller form-factor than typical dual-band systems (i.e. two reflectors to support each of the frequency bands). Specifically, the reflector antenna of a given RF wireless signal system/platform can be large and space-consuming. Thus, by implementing only a single reflector for dual-band signal transmission, as opposed to typical antenna systems that implement multiple reflectors for dual-band signal transmission, the reflectarray antenna system 300 can be implemented in a smaller design package and in a more cost-effective design. Accordingly, the reflector/reflectarray antenna assembly 300 can be utilized in applications where such characteristics can be highly advantageous, such as in a satellite payload.

Figure 8:
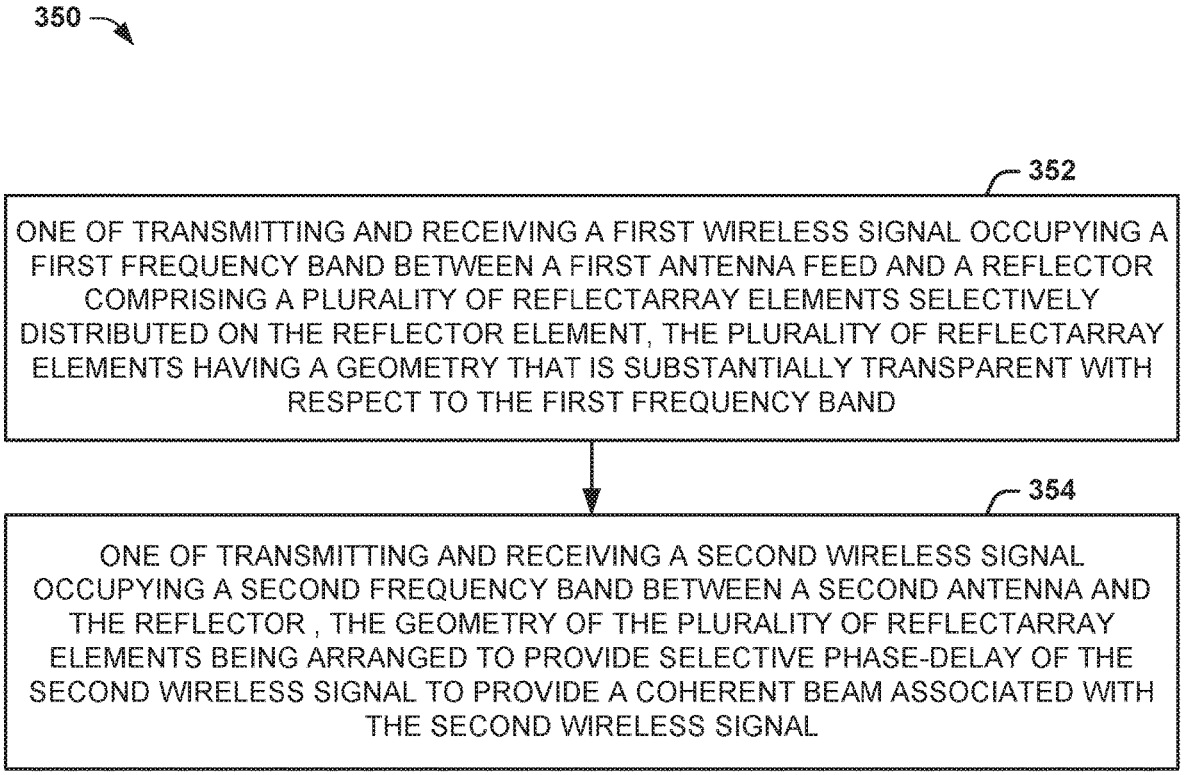
FIG. 8 illustrates an example of a method for providing dual-band wireless transmission via a reflectarray antenna system.

In-view of the foregoing structural and functional features described above, a methodology in accordance with various aspects of the present invention will be better appreciated with reference to FIG. 8. While, for purposes of simplicity of explanation, the methodology of FIG. 8 is shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect of the present invention.

FIG. 8 illustrates an example of a method 350 for providing dual-band signal transmission via a reflectarray antenna system (e.g., the reflectarray antenna system 10). At 352, a first wireless signal (e.g., the first wireless signal $SIG_1$) occupying a first frequency band (e.g., the Ka-band) is one of transmitted and received between a first antenna feed (e.g., the first antenna feed 252) and a reflector (e.g., the reflector 256) comprising a plurality of reflectarray elements (e.g., the reflectarray elements 260) selectively distributed on the reflector. The plurality of reflectarray elements can have a geometry that is substantially transparent with respect to the first frequency band. At 354, a second wireless signal (e.g., the second wireless signal $SIG_2$) occupying a second frequency band (e.g., the W-band) is one of transmitted and received between a second antenna feed (e.g., the second antenna feed 254) and the reflector. The geometry of the plurality of reflectarray elements can be arranged to provide selective phase-delay of the second wireless signal to provide a coherent beam associated with the second wireless signal.

What have been described above are examples of the invention. It is, of course, not possible to describe every conceivable combination of components or methodologies for purposes of describing the invention, but one of ordinary skill in the art will recognize that many further combinations and permutations of the invention are possible. Accordingly, the invention is intended to embrace all such alterations, modifications, and variations that fall within the scope of this application, including the appended claims.

What is claimed is:

1. A reflectarray antenna system comprising:

a first antenna feed configured to at least one of transmit and receive a first wireless signal occupying a first frequency band;

a second antenna feed configured to at least one of transmit and receive a second wireless signal occupying a second frequency band; and a reflector comprising a reflectarray and being configured to provide the first wireless signal and the second wireless signal as a first coherent beam and a second coherent beam, respectively, the reflectarray being configured to selectively phase-delay at least one of the first and second wireless signals to provide the respective at least one of the first and second coherent beams, wherein the reflectarray comprises a plurality of reflectarray elements having a geometry that is tuned to be substantially transparent with respect to the first frequency band and is configured to selectively phase-delay the second wireless signal, and wherein the plurality of reflectarray elements each comprise variable dimensions with respect to each other and are selectively distributed on the reflector to provide the second wireless signal as the second coherent beam based on the selective phase-delay of the second wireless signal of each respective one of the plurality of reflectarray elements.

2. The system of claim 1, wherein the reflector comprises one of a flat surface and a surface that is curved along a single dimension.

3. A reflectarray antenna system comprising:

a first antenna feed configured to at least one of transmit and receive a first wireless signal occupying a first frequency band;

a second antenna feed configured to at least one of transmit and receive a second wireless signal occupying a second frequency band; and a reflector comprising a reflectarray and being configured to provide the first wireless signal and the second wireless signal as a first coherent beam and a second coherent beam, respectively, the reflectarray being configured to selectively phase-delay at least one of the first and second wireless signals to provide the respective at least one of the first and second coherent beams, wherein the reflectarray comprises a plurality of reflectarray elements that are selectively distributed in a plurality of at least partial loops on the reflector, wherein the reflectarray elements in a given one of the plurality of at least partial loops have variable dimensions that are arranged in a decreasing gradient of dimensions from an inner portion of the given one of the plurality of at least partial loops to an outer portion of the given one of the plurality of at least partial loops.

4. The system of claim 3, wherein the reflector comprises one of a flat surface and a surface that is curved along a single dimension.

5. A reflectarray antenna system comprising:

an antenna feed configured to at least one of transmit and receive a wireless signal occupying a frequency band;

a reflector comprising a reflectarray, the reflectarray comprising a plurality of reflectarray elements arranged on a substrate, each of the reflectarray elements comprising a dipole element, wherein the dipole element of at least a portion of the plurality of reflectarray elements comprises, on the same surface of the substrate, a crossed-dipole portion and a looped-dipole portion, the plurality of reflectarray elements being configured to selectively phase-delay the wireless signal to provide the wireless signal as a coherent beam.

6. The system of claim 5, wherein the surface is either flat or curved along a single dimension.

7. The system of claim 5, wherein the antenna feed is a first antenna feed configured to transmit and/or receive a first wireless signal occupying a first frequency band, the system further comprising a second antenna feed configured to transmit and/or receive a second wireless signal occupying a second frequency band, wherein the reflectarray elements are configured to selectively phase-delay the first wireless signal and/or the second wireless signal to provide the first and second wireless signals as a first and second coherent beam, respectively.

8. The system of claim 7, further comprising:

a first sub-reflector configured to reflect the first wireless signal between the first antenna feed and the reflector; and a second sub-reflector configured to reflect the second wireless signal between the second antenna feed and the reflector, wherein at least one of the first and second sub-reflectors are arranged substantially off-focus from the reflector.

9. The system of claim 8, wherein at least one of the first and second antenna feeds is a horn feed.

10. The system of claim 8, wherein at least one of the first and second antenna feeds is an active electronically scanned array (AESA).

11. The system of claim 7, wherein the first frequency band is the Ka-band and the second frequency band is the W-band.

12. The system of claim 7, wherein the plurality of reflectarray elements have a geometry that is tuned to be substantially transparent with respect to the first frequency band and is configured to selectively phase-delay the second wireless signal.

13. The system of claim 12, wherein the plurality of reflectarray elements each have variable dimensions with respect to each other and are selectively distributed on the reflector to provide the second wireless signal as the coherent beam based on the selective phase-delay of the second wireless signal of each respective one of the plurality of reflectarray elements.

14. The system of claim 13, wherein the plurality of reflectarray elements are selectively distributed in a plurality of at least partial loops on the reflector, wherein the variable dimensions associated with reflectarray elements in a given one of the plurality of at least partial loops are arranged in a decreasing gradient of dimensions from an inner portion of the given one of the plurality of at least partial loops to an outer portion of the given one of the plurality of at least partial loops.

15. The system of claim 5, wherein the dipole element associated with a first portion of the plurality of reflectarray elements comprises the crossed-dipole portion and the looped-dipole portion, and wherein the dipole element associated with a second portion of the plurality of reflectarray elements comprises the crossed-dipole portion absent the looped-dipole portion, wherein the first and second portions of the plurality of reflectarray elements are distributed in a substantially uniform state pattern distribution across the reflector with respect to the dipole element associated with each of the plurality of reflectarray elements.

16. The system of claim 15, wherein the reflector comprises alternating curved spatial bands of:

(a) reflectarray elements comprising both crossed-dipole and looped-dipole portions, and (b) reflectarray elements comprising only crossed-dipole portions without looped-dipole portions.

17. The system of claim 16, wherein, within each of the curved spatial bands having reflectarray elements comprising only crossed-dipole portions without looped-dipole portions, the reflectarray elements vary in size according to the gradient of the bands.

18. The system of claim 5, wherein the crossed-dipole portion of the dipole element of each of the plurality of reflectarray elements comprises a contiguous conductive portion arranged as a pair of orthogonal intersecting strips disposed on a substrate and having a perimeter, and wherein the looped-dipole portion of the dipole element of each of the at least a portion of the plurality of reflectarray elements comprises a second contiguous conductive portion that extends at least partially around the first contiguous portion and has a perimeter that is concentric with respect to the perimeter of the first contiguous conductive portion.

19. The system of claim 18, wherein the second contiguous portion surrounds the first contiguous portion and is spaced apart from the first contiguous portion at each end of the pair of orthogonal intersecting strips and along each point of the pair of orthogonal intersecting strips by an approximately equal distance.

20. The system of claim 5, wherein the substrate is a single-layer substrate, wherein the dipole element of each of the plurality of reflectarray elements is disposed on the substrate, and wherein the substrate interconnects the dipole element and a conductive ground layer.

* * * * *